US012729049B2

(12) United States Patent
Teng et al.

(10) Patent No.: US 12,729,049 B2
(45) Date of Patent: Sep. 8, 2026

(54) CONTAINERS, SAMPLE CONTAINERS AND ASSOCIATED METHODS

(71) Applicant: Battelle Energy Alliance, LLC, Idaho Falls, ID (US)

(72) Inventors: Fei Teng, Ammon, ID (US); Timothy D. Bragg, Idaho Falls, ID (US); Colin D. Judge, Idaho Falls, ID (US); Jeffrey J. Giglio, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 98 days.

(21) Appl. No.: 18/506,932

(22) Filed: Nov. 10, 2023

(65) Prior Publication Data

US 2025/0153921 A1 May 15, 2025

(51) Int. Cl.

| | |
|---|---|
| ***B65D 81/20*** | (2006.01) |
| ***B65D 45/24*** | (2006.01) |
| ***B65D 53/02*** | (2006.01) |

(52) U.S. Cl.

CPC ..... *B65D 81/2069* (2013.01); *B65D 45/24* (2013.01); *B65D 53/02* (2013.01)

(58) Field of Classification Search

CPC .... B65D 81/2069; B65D 45/24; B65D 53/02; Y10T 137/86332

USPC ..... 220/8, 368; 137/588, 254, 625.47, 88; 435/287.1–287.2, 286.7, 288.5, 6.11; 141/65–66; 222/190, 135, 152, 189.06, 222/23, 318, 386.5, 394, 399, 420, 514, 222/61, 63, 64, 72

See application file for complete search history.

(56) References Cited

U.S. PATENT DOCUMENTS 1,672,904 A * 6/1928 Randall ..... B65D 81/3818 220/592.27

2,751,953 A * 6/1956 Grimm ..... B65D 37/00 428/34.1

(Continued)

FOREIGN PATENT DOCUMENTS

KR 10-2020-0085584 A 7/2020

OTHER PUBLICATIONS

Gas and Vapor Sampling Kit [Online]; "Gas and Vapor Sampling Kit (Contains Canister, Bulb, 10 Bags, Marker Pen and Instructions)", Brand: Trajan (SGE); Analytics-Shop.com; Retrieved on Nov. 10, 2023 from the internet: <URL: https://www.analytics-shop.com/us/sg090111?utm_source=google_shopping&utm_medium=cpc&srsltid=AR57-fDU3fkPxqhmcrCDWYsobcj6p8v2quieUMEAPd7hs_ZkStQm8IU57mY>.

(Continued)

*Primary Examiner* — Orlando E Aviles
*Assistant Examiner* — Brijesh V. Patel
(74) *Attorney, Agent, or Firm* — TraskBritt

(57) ABSTRACT

A container includes a base including at least one base seal. The container further includes a shell configured to be disposed at least partially over the base and interface with the at least one base seal. The shell includes an inlet port extending through the shell. The inlet port is configured to create a fluid connection to a cavity defined within the shell. The shell further includes an outlet port extending through the shell. The outlet port is configured to create a fluid connection to the cavity defined within the shell. The shell also includes a seal extending across the inlet port and the outlet port. The seal is configured to form a substantially fluid tight seal between the cavity and the inlet port and the outlet port.

18 Claims, 11 Drawing Sheets

(56) References Cited

U.S. PATENT DOCUMENTS 3,170,607 A * 2/1965 Anthon ..... B65D 45/02 222/542
3,471,178 A * 10/1969 Roe ..... F16L 39/00 156/289
3,582,096 A * 6/1971 Norton ..... F16L 39/00 277/606
3,916,960 A * 11/1975 Thompson ..... B01J 8/0015 141/1
3,943,987 A * 3/1976 Rossi ..... B65D 81/2015 206/524.8
4,051,971 A * 10/1977 Saleri ..... B65D 81/2038 99/476
4,362,095 A * 12/1982 Wheatley ..... A47J 47/06 206/524.8
4,422,788 A * 12/1983 Braithwaite ..... B05C 21/00 401/203
4,465,189 A * 8/1984 Molzan ..... B65D 81/24 206/811
4,541,537 A * 9/1985 Sailor ..... A61J 1/1412 285/353
4,676,283 A * 6/1987 Caldwell ..... B01F 35/7176 261/DIG. 7
4,922,960 A * 5/1990 Oelschlaegel ..... F16K 24/00 251/180
4,993,573 A * 2/1991 Freidel ..... B01L 3/565 215/276
5,002,154 A * 3/1991 Chen ..... F01M 11/045 141/27
5,240,144 A * 8/1993 Feldman ..... B67D 1/0462 222/105
5,390,809 A * 2/1995 Lin ..... F16K 15/1825 220/592.27
5,398,811 A * 3/1995 Latella, Jr. ..... A47J 47/04 206/524.8
5,406,992 A * 4/1995 Miramon ..... A47G 19/2272 220/203.02
5,469,979 A * 11/1995 Chiou ..... B65D 81/2038 220/625
5,570,628 A * 11/1996 Kiener ..... B65D 81/20 99/467
5,597,086 A * 1/1997 King-Shui ..... A47J 41/02 220/592.16
5,692,632 A * 12/1997 Hsieh ..... B65D 81/20 220/240
5,697,510 A * 12/1997 Wang ..... B65D 51/1683 215/310
5,775,357 A * 7/1998 Regna ..... F16K 15/031 137/527.6
5,779,082 A * 7/1998 Miramon ..... B65B 31/047 220/240
5,803,282 A * 9/1998 Chen ..... B65B 31/047 220/DIG. 16
5,806,575 A * 9/1998 Tsay ..... B65D 81/2015 141/192
5,865,037 A * 2/1999 Bostic ..... B65D 81/2038 220/361
5,924,585 A * 7/1999 Henderson ..... B67D 7/0288 215/319
6,135,277 A * 10/2000 Armstrong ..... A47F 3/005 206/45.24
6,145,685 A * 11/2000 Dick ..... B65D 21/0228 220/23.91
6,264,054 B1 * 7/2001 Miyake ..... B65D 81/2038 220/23.91
6,412,669 B1 * 7/2002 Chuang ..... B05B 7/2421 222/401
6,644,489 B2 * 11/2003 Chang ..... B65D 81/2038 215/311
6,725,632 B2 * 4/2004 Glucksman ..... B65B 31/028 251/251
6,830,081 B1 * 12/2004 Chen ..... F04B 35/04 220/203.19
6,877,629 B2 * 4/2005 Meyer ..... A47J 47/10 206/524.8
7,296,598 B2 * 11/2007 Lin ..... B65D 81/2038 220/240
7,723,701 B1 * 5/2010 Walck ..... B01L 3/508 220/8
7,861,875 B2 * 1/2011 Johns ..... B01J 8/06 73/49.8
7,931,052 B2 * 4/2011 Schooley ..... B65D 81/2015 141/8
8,069,987 B2 * 12/2011 Choy ..... B65D 81/2015 220/592.01
8,439,216 B1 5/2013 Walck
9,108,778 B2 * 8/2015 Wang ..... B65D 51/165
9,145,242 B2 * 9/2015 Wang ..... A47J 47/06
9,422,069 B2 * 8/2016 Valicek ..... B65B 57/005
9,725,224 B2 * 8/2017 Han ..... B65D 81/2038
9,745,969 B2 8/2017 Viehe
10,722,427 B2 * 7/2020 Cantor ..... A61J 1/165
10,982,812 B2 * 4/2021 Cadogan ..... F17C 3/04
11,117,730 B2 * 9/2021 Lapidot ..... A47J 47/02
2002/0074259 A1 * 6/2002 Gutierrez ..... A45C 11/20 206/524.8
2002/0108657 A1 * 8/2002 Chen ..... B65D 81/2038 137/565.13
2006/0138068 A1 * 6/2006 Tsai ..... B65D 81/2038 215/230
2006/0151354 A1 * 7/2006 Dombroski ..... B65D 81/2053 206/524.8
2007/0062584 A1 * 3/2007 Prahl ..... F16L 41/08 137/588
2007/0205194 A1 * 9/2007 Tung ..... B65D 81/263 220/203.15
2007/0215510 A1 * 9/2007 Sung ..... B65D 79/0087 206/524.8
2008/0078466 A1 * 4/2008 Wang ..... B65D 81/2038 141/65
2010/0200599 A1 * 8/2010 Molthen ..... B65D 19/06 220/592.27
2012/0125936 A1 * 5/2012 Byers ..... C12M 23/04 220/367.1
2020/0166435 A1 * 5/2020 Sherwood ..... G16H 50/30
2023/0126474 A1 * 4/2023 Lautenschläger ..... B01J 3/04 137/254

OTHER PUBLICATIONS

Rave Scientific Inert Gas Sample Storage Container [Online]; "Inert Gas Sample Storage Container", Rave Scientific; Retrieved on Nov. 10, 2023 from the internet: <URL: https://ravescientific.com/sample-preparation/sample-storage/category/em-tec-save-storr> (6 pages).
South Bay Technologies SampleSaver [Online]; "SampleSaver Storage Container", South Bay Technology, Inc.; Retrieved on Nov. 10, 2023 from the internet: <URL: http://www.southbaytech.com/shop/SS1.shtml> (1 page).

* cited by examiner

CONTAINERS, SAMPLE CONTAINERS AND ASSOCIATED METHODS

STATEMENT REGARDING FEDERALLY SPONSORED RESEARCH OR DEVELOPMENT

This invention was made with government support under Contract Number DE-AC07-05ID14517 awarded by the United States Department of Energy. The government has certain rights in the invention.

TECHNICAL FIELD

Storage containers are disclosed. More specifically, sealed storage containers, such as sample storage containers or controlled atmosphere storage containers and methods are disclosed.

BACKGROUND

Many materials are reactive to atmospheric gases, such as oxygen and nitrogen. The reactivity of these materials may cause the materials to degrade when exposed to atmospheric gases. Thus, storing material samples in a conventional storage area may result in the material degrading, such as through oxidation, until the material sample is no longer usable. For example, materials such as uranium (U), uranium zirconium (U—Zr), cerium Nitride (CeN), and plutonium (P), may be highly reactive to oxygen and may oxidize when stored in atmospheric gases.

Storage containers for storing material samples may be configured to remove atmospheric gases, such as through a vacuum. Removing the atmospheric gases may increase a time that the samples can be stored before the materials degrade.

BRIEF SUMMARY

Embodiments of the disclosure include a container. The container includes a base including at least one base seal. The container further includes a shell configured to be disposed at least partially over the base and interface with the at least one base seal. The shell includes an inlet port extending through the shell. The inlet port is configured to create a fluid connection to a cavity defined within the shell. The shell further includes an outlet port extending through the shell. The outlet port is configured to create a fluid connection to the cavity defined within the shell. The shell also includes a seal extending across the inlet port and the outlet port. The seal is configured to form a substantially fluid tight seal between the cavity and the inlet port and the outlet port.

Another embodiment of the disclosure includes a method of storing a sample. The method includes enclosing the sample in a volume defined by a container. The method further includes removing atmospheric gases from the volume. The method also includes inputting a non-reactive gas into the volume. The non-reactive gas substantially replaces the atmospheric gases in the volume and maintains a pressure of the volume. The method further includes sealing the container.

Other embodiments of the disclosure include a sample container. The sample container includes a base including at least one base seal and a post configured to secure a sample to the base. The sample container further includes a shell configured to be disposed at least partially over the base and interface with the at least one base seal. The shell includes an inlet extending through an upper surface of the shell. The inlet is configured to create a first fluid connection to a cavity defined within the shell. The shell further includes an outlet extending through the upper surface of the shell. The outlet is configured to create a second fluid connection to the cavity defined within the shell.

BRIEF DESCRIPTION OF THE DRAWINGS

While the specification concludes with claims particularly pointing out and distinctly claiming embodiments of the disclosure, the advantages of embodiments of the disclosure may be more readily ascertained from the following description of embodiments of the disclosure when read in conjunction with the accompanying drawings in which:

DETAILED DESCRIPTION

Figure 1:
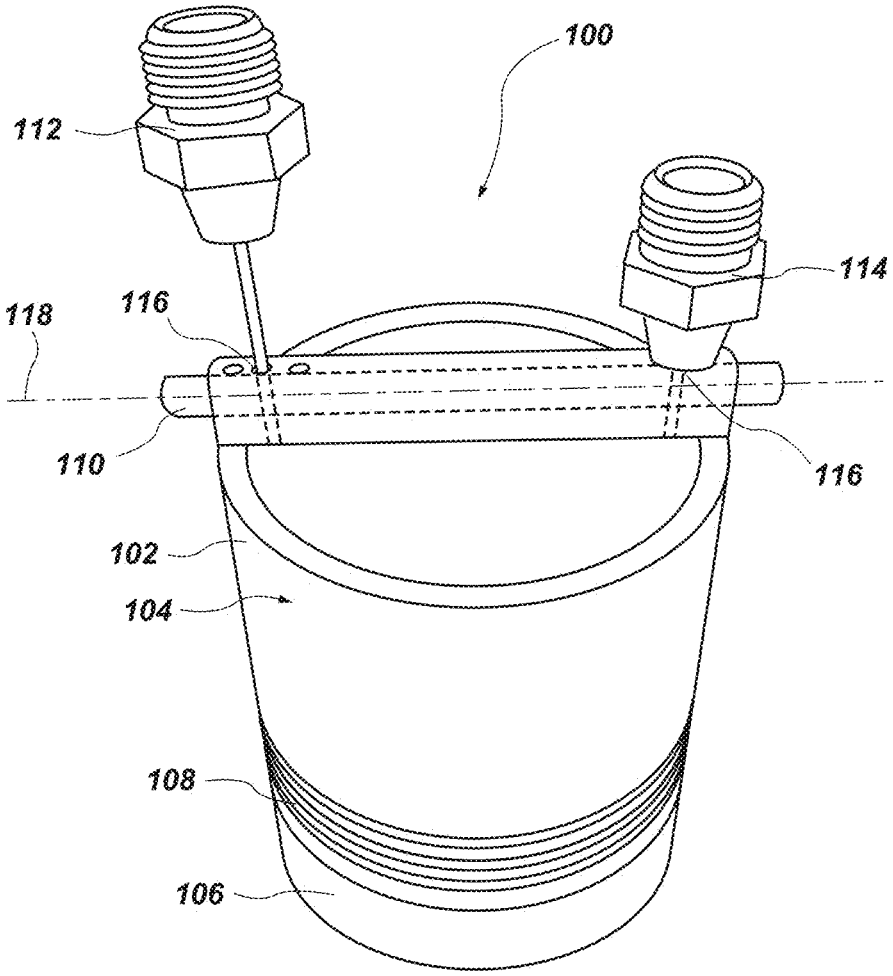
FIG. 1 illustrates an isometric view of a container in accordance with embodiments of the disclosure.

The following description provides specific details, such as material compositions, shapes, and sizes, in order to provide a thorough description of embodiments of the disclosure. However, a person of ordinary skill in the art would understand that the embodiments of the disclosure may be practiced without employing these specific details. Indeed, the embodiments of the disclosure may be practiced in conjunction with conventional techniques employed in the industry.

Drawings presented herein are for illustrative purposes only and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the terms "configured" and "configuration" refer to a size, a shape, a material composition, a material distribution, orientation, and arrangement of at least one feature (e.g., one or more of at least one structure, at least one material, at least one region, at least one device) facilitating use of the at least one feature in a pre-determined way.

As used herein, the term "substantially" in reference to a given parameter means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0 percent met, at least 95.0 percent met, at least 99.0 percent met, at least 99.9 percent met, or even 100.0 percent met.

As used herein, "about" in reference to a numerical value for a particular parameter is inclusive of the numerical value and a degree of variance from the numerical value that one of ordinary skill in the art would understand is within acceptable tolerances for the particular parameter. For example, "about" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, relational terms, such as "below," "lower," "bottom," "above," "upper," "top," and the like, may be used for ease of description to describe one element's or feature's relationship to another element(s) or feature(s) as illustrated in the drawings. Unless otherwise specified, the spatially relative terms are intended to encompass different orientations of the materials in addition to the orientation depicted in the figures. For example, if materials in the figures are inverted, elements described as "below" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, the term "and/or" means and includes any and all combinations of one or more of the associated listed items.

As used herein, the terms "vertical," "longitudinal," "horizontal," and "lateral" are in reference to a major plane of a structure and are not necessarily defined by earth's gravitational field. A "horizontal" or "lateral" direction is a direction that is substantially parallel to the major plane of the structure, while a "vertical" or "longitudinal" direction is a direction that is substantially perpendicular to the major plane of the structure. The major plane of the structure is defined by a surface of the structure having a relatively large area compared to other surfaces of the structure.

As used herein "atmospheric gases" means and includes a majority of gases in the surrounding environment including oxygen ($O_2$) and nitrogen ($N_2$).

The storage of samples that are sensitive to atmospheric gases, such as oxygen and nitrogen, is a challenge for materials science research because materials may be gathered or procured long before the materials are used for any experimentation or tests. In other cases, the materials may be stored between different tests (e.g., follow-on research testing or experiments). Materials such as lithium (Li), sodium (Na), uranium (U), uranium-zirconium (U—Zr), uranium-molybdenum (U—Mo), cerium nitride (CeN), and plutonium (Pu)-based materials are reactive to oxygen. Other materials may be easily oxidized due to large surface energies, such as samples prepared through Focused Ion Beam (FIB), mechanical polishing, electro jet polishing, etc., for Transmission Electron Microscopy (TEM), Scanning Electron Microscopy (SEM), Atom Probe Tomography (APT), etc., which may be used in biotech and pharmaceutical research among others. As the materials oxidize, properties of the materials may change significantly compared to the original condition, which makes follow-on research more expensive and may create hazards. For example, some oxidized nuclear materials may become airborne, creating hazardous conditions for personnel working with the oxidized nuclear materials.

In some cases, removing oxygen, such as in a vacuum, may reduce oxidization of the stored materials. However, it is difficult to maintain a vacuum for long periods of time. For example, reducing the pressure inside a container to create the vacuum may induce atmospheric gases outside the container to enter the container due to the pressure differences between the environment inside the container and the environment outside the container. Storing the materials in a controlled atmosphere (e.g., oxygen free) container at substantially a same pressure as an environment outside the container may substantially reduce oxidization of the materials during storage while also reducing the ingress of atmospheric gases. A controlled atmosphere may be created by replacing oxygen in the container with another less reactive gas, such as an inert gas (e.g., helium, neon, argon, krypton, xenon, or radon).

FIG. 1 illustrates a container 100 for storing sample materials according to embodiments of the disclosure. The container 100 includes a shell 102 and a base 106 together defining a cavity 104 for receiving a sample material for storage. The shell 102 and the base 106 may be formed from rigid materials that are substantially impermeable to gases. In some embodiments, the shell 102 is formed from the same material as the base 106. In other embodiments, the base 106 and the shell 102 may be formed from different materials. The materials for the base 106 and the shell may be selected from materials that are readily available and inexpensive, such that the base 106 and the shell 102 may be easily replaced or disposable. The shell 102 may be coupled to the base 106 through one or more base seals 108. The base seals 108 may be configured to form a substantially fluid tight seal (e.g., a seal configured to substantially prevent the passage of liquids or gases) between an environment inside the container 100 and an environment outside the container 100. In particular, the base seals 108 may be configured to substantially prevent the passage of oxygen and other larger elements and molecules.

The base seals 108 may be formed of and include one or more flexible materials, such as rubber and other elastomeric polymer materials. In some embodiments, such as high temperature applications, the base seals 108 may be formed from materials configured to withstand high temperatures while forming a seal, such as metal materials (e.g., copper) or graphite. The base seals 108 may be formed into sealing rings, such as O-rings, extending around a protrusion from the base 106 configured to be received in an interior portion of the shell 102. As illustrated in FIG. 1, the base 106 may include multiple base seals 108, such as two base seals 108, three base seals 108, four base seals 108, or five base seals 108. Additional base seals 108 may provide redundancy for the seal between the base 106 and the shell 102. In some embodiments, the base seals 108 are progressive in size, such that the base seals 108 have differing outer diameters to provide progressively tighter seals at each base seal 108. For example, an upper base seal 108 (e.g., the base seal 108 the greatest distance from the base 106) may have a greater diameter than a lower base seal 108 (e.g., the base seal 108 closest to the base 106). In another example, the lower base seal 108 may have a greater outer diameter than the upper base seal 108.

The shell 102 may include one or more ports 116 defined in the shell 102. In the embodiment illustrated in FIG. 1, the shell 102 includes two ports 116 defined in a top surface of the shell 102. The ports 116 are configured to facilitate the removal of atmospheric gases such as oxygen and the replacement of the atmospheric gases with another less reactive gas. An outlet 112 and an inlet 114 may be coupled to the ports 116. The inlet 114 is configured to supply the less reactive gas and the outlet 112 is configured to remove the atmospheric gases. The less reactive gas may be an inert gas, such as neon, argon, krypton, xenon, radon, or a combination thereof. The inert gas may be selected to be atomically heavier than oxygen (e.g., having a greater atomic weight than oxygen). By selecting an inert gas that is heavier than oxygen, the inert gas may flow to a lower portion of the cavity 104 and cause the oxygen in the container 100 to rise to an upper portion of the cavity 104, where the oxygen may then exit the cavity 104 through the outlet 112.

In the embodiment illustrated in FIG. 1, the inlet 114 and the outlet 112 are needles. The needles may be rigid tubes that define a hollow space within the needle to facilitate the passage of a fluid (e.g., a gas or a liquid) through the needle. The needles may be inserted to different depths in the cavity 104. As illustrated in FIG. 1, the inlet 114 needle is inserted to a greater depth in the cavity 104 than the outlet 112 needle. This may facilitate efficiently supplying the inert gas to the lower portion of the cavity 104 and removing the oxygen from the upper portion of the cavity 104 by substantially reducing short cycling of the inert gas (e.g., the inert gas passing directly from the inlet 114 to the outlet 112 before sinking to the lower portion of the cavity 104). The ports 116 may extend through a shell seal 110. The ports 116 in the shell seal 110 may facilitate the passage of the needles for the outlet 112 and the inlet 114. In some embodiments, the inlet 114 and outlet 112 needles may form the ports 116 through the shell seal 110 by puncturing the material of the shell seal 110 to pass through the shell seal 110. As discussed in further detail below, the ports 116 defined through the shell seal 110 may be configured to close and form a substantially fluid tight seal responsive to an applied pressure along a longitudinal axis 118 of the shell seal 110.

In other embodiments, the inlet 114 and the outlet 112 may be valves configured to connect to a gas supply or gas exhaust and to open to receive the inert gas. The valves may be configured to exhaust the oxygen and close once the oxygen has been replaced with the inert gas to seal the cavity 104.

In some embodiments, the container 100 may be configured, such that the base 106 is positioned at a top of the container 100. For example, the shell 102 may form an open container, with an opening at a top of the shell 102. The base 106 may act as a lid sealing the opening at the top of the shell 102 with the base seals 108. In these embodiments, the ports 116 may also be defined in the base 106. In other embodiments, the ports 116 may remain within the shell 102, such as through a side wall of the shell 102. Positioning the base 106 at the top of the container 100 may facilitate temporarily removing the base 106 while maintaining the inert gas in the shell 102. For example, in embodiments where the inert gas is heavier than the atmospheric gases, the inert gas may remain within the shell 102 if the base 106 is removed from the top of the shell 102 for a short period of time. This may facilitate adding additional samples to the container 100 or performing minor processes within the container 100, such as taking measurements.

Figure 2:
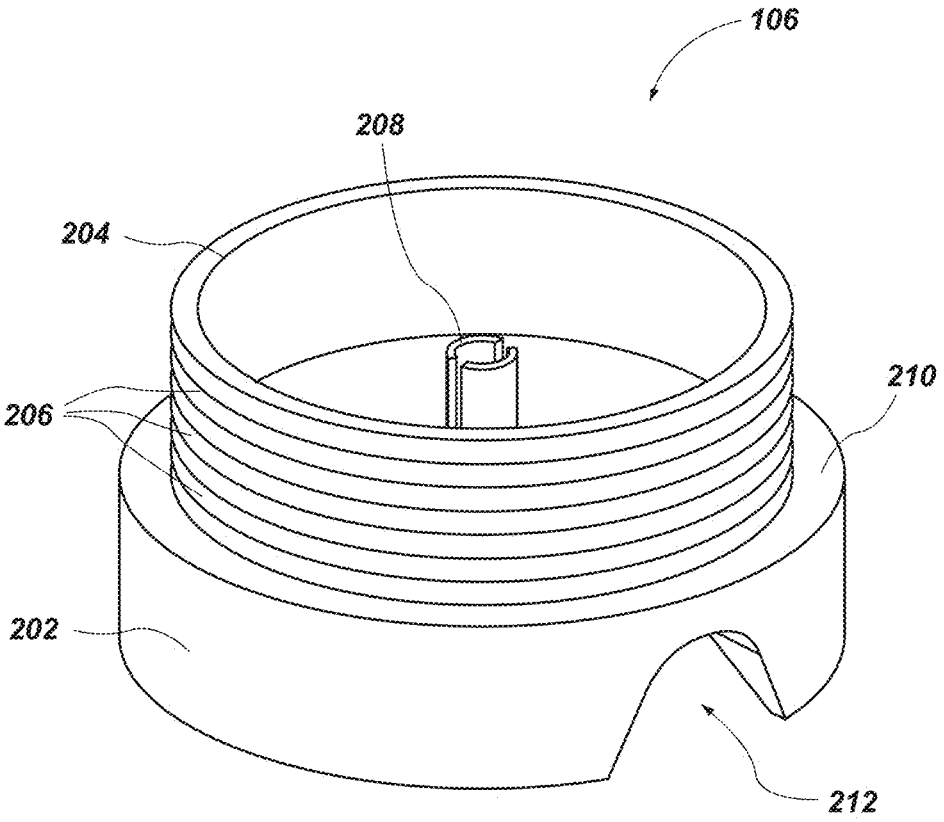
FIG. 2 illustrates a base of the container of FIG. 1 in accordance with embodiments of the disclosure.

FIG. 2 illustrates the base 106 of the container 100. The base 106 includes a platform 202 and a protrusion 204 extending from the platform 202. The protrusion 204 includes annular base seal recesses 206 configured to receive the base seals 108 discussed above. The base seal recesses 206 may be defined annularly around an outer surface of the protrusion 204, such that the base seals 108 (FIG. 1) disposed therein will contact an inner surface of the shell 102 (FIG. 1) when the protrusion 204 is disposed into the cavity 104 (FIG. 1) defined therein. The base seal recesses 206 may have a complementary shape to the base seals 108. For example, if the base seals 108 have a circular cross-section, the base seal recesses 206 will have a rounded cross-section. Similarly, if the base seals 108 (FIG. 1) have a rectangular cross-section, the base seal recesses 206 will also have a rectangular cross-section. If the base seals 108 are progressively sized, the base seal recesses 206 may be correspondingly progressively sized. The base seal recesses 206 may have a depth less than a major dimension (e.g., diameter, apothem, width, etc.) of the cross-section of the associated base seal 108 (FIG. 1), such that the base seal 108 (FIG. 1) extends beyond an outer circumference of the protrusion 204.

A post 208 may extend from the platform 202 in a central portion of the base 106. The post 208 may be configured to interface with a sample, such as to secure the sample to the base 106 or to center the sample and secure the sample radially relative to the base 106. In the embodiment illustrated in FIG. 2, the post 208 has a substantially circular cylindrical shape formed by two posts forming opposing arcs. In other embodiments, the post 208 may be a single circular cylinder, a single rectangular cylinder, multiple cylinders, a prism, a cone, etc. In some embodiments, the shape of the post 208 is configured to interface with specific types of samples, such as Focused Ion Beam (FIB) prepared samples for Transmission Electron Microscopy (TEM), Scanning Electron Microscopy (SEM), Atom Probe Tomography (APT), etc., which may each have distinct interface shapes determined by the industry.

The platform 202 may extend radially beyond an outer circumference of the protrusion 204 to form a shelf 210. The shelf 210 is configured to act as a stop when the shell 102 (FIG. 1) is disposed over the protrusion 204. The shelf 210 may contact a bottom surface of the shell 102 (FIG. 1), such that the bottom surface of the shell 102 rests against (e.g., contacts) the shelf 210.

The shell 102 may also include a recess 212 defined from a bottom surface of the platform 202 opposite the protrusion 204. In some embodiments, the recess 212 is configured to interface with a feature on a shelf or another container 100 (FIG. 1), such as a complementary feature (e.g., protrusion) extending from a top surface of a shell 102 (FIG. 1) of another container 100 (FIG. 1). The recess 212 may be configured to retain the base 106 in position relative to an adjacent shelf or an adjacent container 100 (FIG. 1), such that the base 106 secures the associated container 100 (FIG. 1) during storage and multiple containers 100 (FIG. 1) may be stacked during storage.

Figure 3:
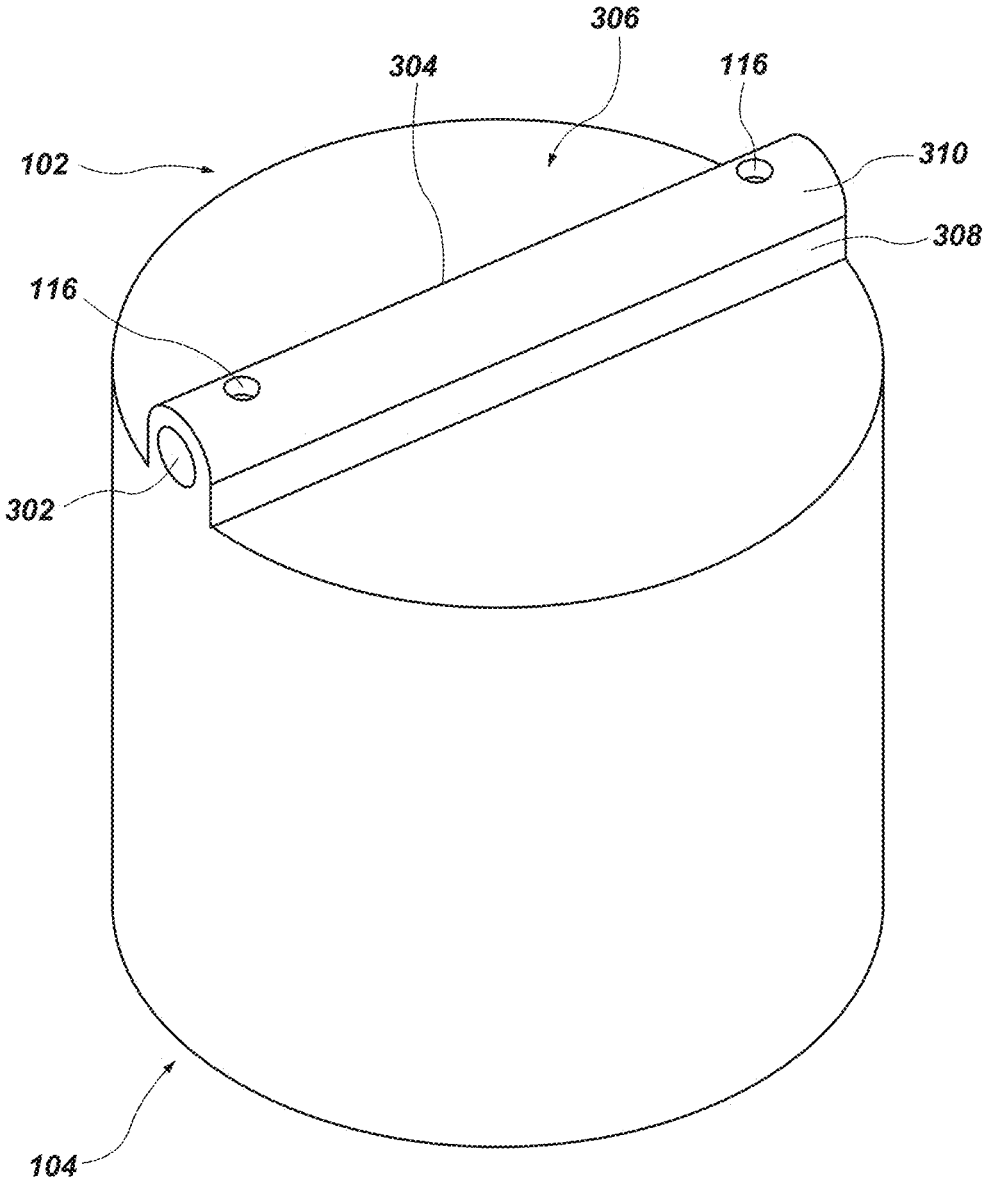
FIG. 3 illustrates an isometric view of a shell of the container of FIG. 1 in accordance with embodiments of the disclosure.
Figure 4:
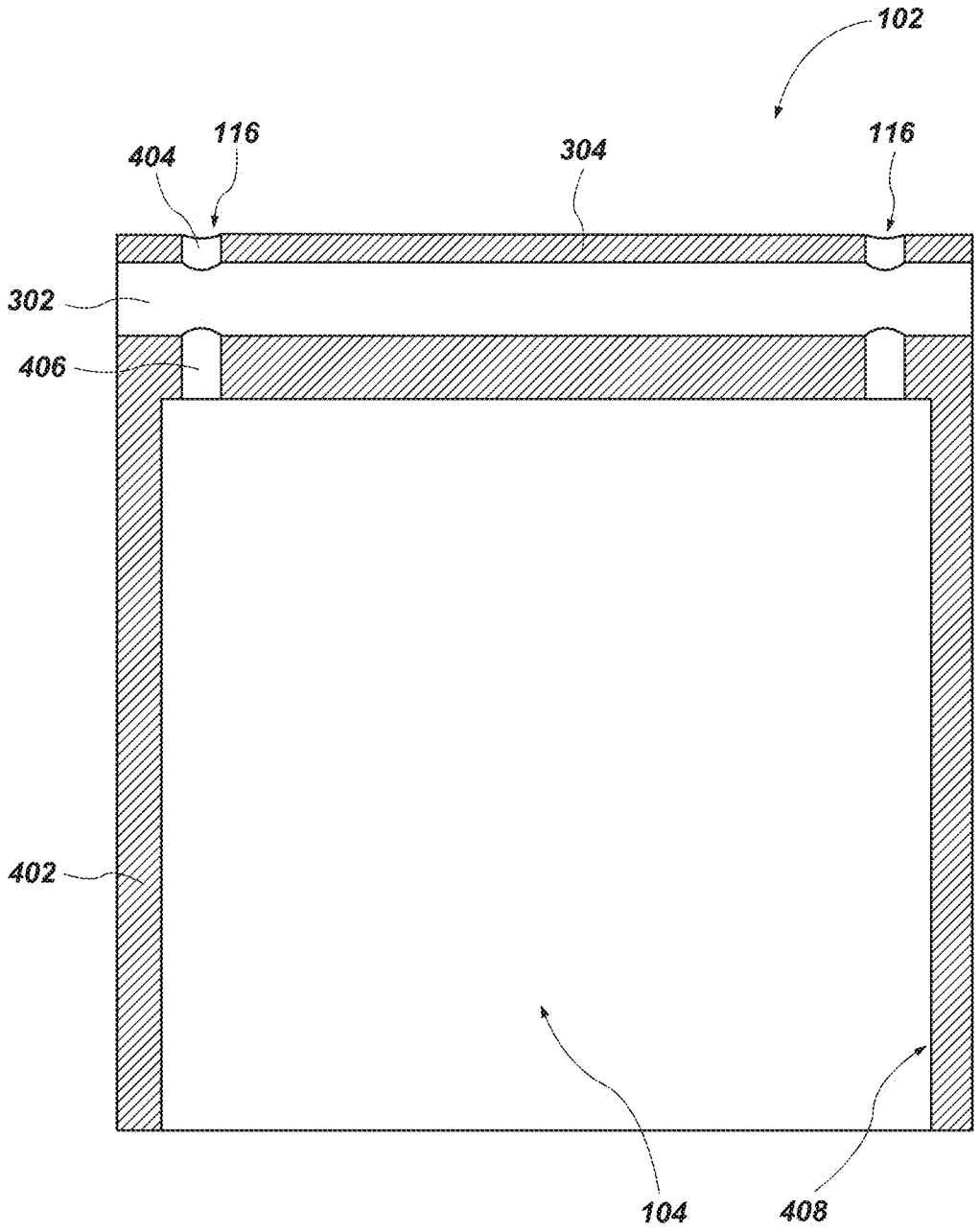
FIG. 4 illustrates a cross-sectional view of the shell of FIG. 1 in accordance with embodiments of the disclosure.

FIGS. 3 and 4 illustrate different views of the shell 102 illustrated in FIG. 1. FIG. 3 is a perspective view of the shell 102. The shell 102 may include a shell seal structure 304 configured to receive and position the shell seal 110 (FIG. 1). As illustrated in FIG. 3, the shell seal structure 304 includes a shell seal receiving aperture 302 defined in the shell seal structure 304. The shell seal structure 304 may also include the ports 116. The shell seal structure 304 may protrude from a top surface 306 of the shell 102.

In some embodiments, the shell seal structure 304 has a complementary size and shape to the recess 212 (FIG. 2) in the base 106 (FIG. 2). Thus, the combination of the recess 212 (FIG. 2) and the shell seal structure 304 may facilitate stacking multiple containers 100 (FIG. 1), which may reduce storage space used to store multiple samples. In the embodiment illustrated in FIG. 3, the shell seal structure 304 includes substantially planar side surfaces 308 and a domed or rounded top surface 310 extending between the side surfaces 308. In other embodiments, the top surface 310 may be planar, such that the shell seal structure 304 has a substantially rectangular cross-section.

In the embodiment illustrated in FIG. 3, the shell seal receiving aperture 302 has a circular cross-section. In other embodiments, the shell seal receiving aperture 302 may have other different cross-sectional shapes, such as a rectangular cross-section, a triangular cross-section, and other cross-sections (e.g., rounded rectangles, house shapes, etc.).

FIG. 4 illustrates a cross-sectional view of the shell 102. As discussed above, the shell 102 defines a cavity 104 between walls 402 of the shell 102. The walls 402 of the shell 102 include an inner surface 408 configured to interface with the protrusion 204 (FIG. 2) from the base 106 (FIGS. 1 and 2). For example, the inner surface 408 of the walls 402 of the shell 102 may have an inner major dimension (e.g., diameter, width, apothem) similar to an outer major dimension (e.g., diameter, width, apothem) of the protrusion 204 (FIG. 2). Any difference between the inner major dimension of the inner surface 408 of the walls 402 of the shell 102 and the outer major dimension of the protrusion 204 (FIG. 2) may be a clearance dimension to facilitate passing the shell 102 over the protrusion 204 (FIG. 2) and to accommodate the base seals 108 (FIG. 1). The base seals 108 are configured to form a substantially fluid tight seal between the base 106 (FIGS. 1 and 2) and the inner surface 408 of the walls 402 of the shell 102.

The ports 116 may extend through the shell seal structure 304 into the cavity 104. The shell seal receiving aperture 302 intersects the ports 116, such that the shell seal 110 may seal the ports 116 when the ports 116 are not in use. The ports 116 are divided into an outer port 404 and an inner port 406 by the shell seal receiving aperture 302. The outer port 404 is positioned on an opposite side of the shell seal receiving aperture 302 from the cavity 104. The inner port 406 is positioned between the shell seal receiving aperture 302 and the cavity 104. In the embodiment illustrated in FIG. 4, the inner port 406 has a greater length than the outer port 404. In other embodiments, the inner port 406 and the outer port 404 may have substantially a same length.

Figure 5:
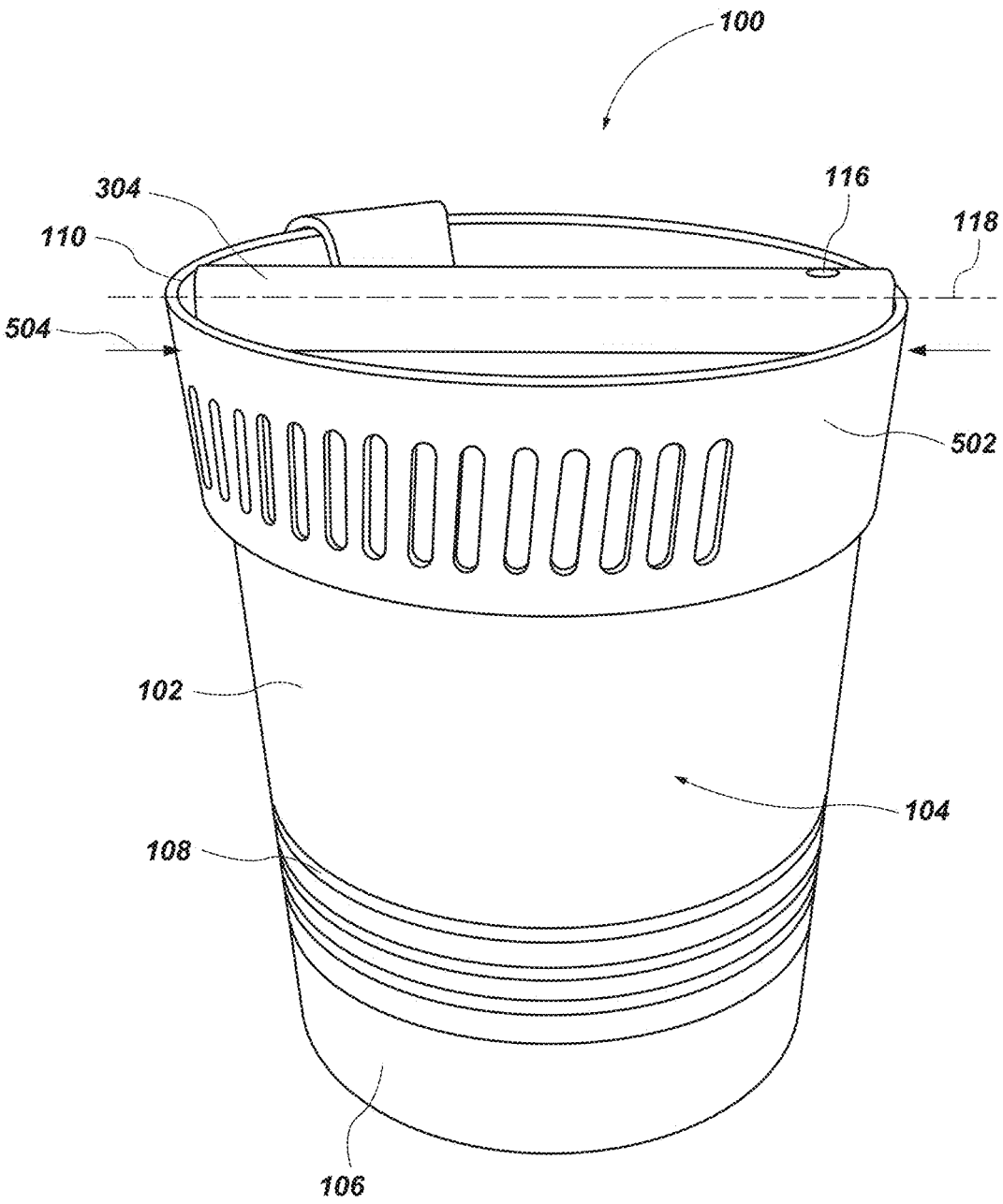
FIG. 5 illustrates the container of FIG. 1 in a sealed configuration in accordance with embodiments of the disclosure.

FIG. 5 illustrates the container 100 in a sealed configuration. After oxygen in the cavity 104 is replaced with a less reactive gas, the inlet 114 and the outlet 112 are removed or closed and the container 100 is sealed.

In the embodiment illustrated in FIG. 5, the ports 116 are sealed by applying an axial force to the shell seal 110 in a direction along the longitudinal axis 118 of the shell seal 110. The axial force may cause the ports 116 through the shell seal 110 to close and create a substantially fluid tight seal. In the embodiment illustrated in FIG. 5, the axial force is applied through a clamp 502, such as a band clamp or a bar clamp. The clamp is configured to contact (e.g., engage) opposing axial ends of the shell seal 110 and apply a force 504 inward in a direction along the longitudinal axis 118 to compress the shell seal 110.

Replacing the oxygen in the container 100 with a heavier less reactive gas, such as an inert gas, as discussed above, may reduce the degradation of the material stored in the container 100. The heavier less reactive gas may be maintained in the container 100 through the base seals 108 and the shell seal 110. The heavier less reactive gas may have larger atoms or molecules than the oxygen, such that the heavier less reactive gas may be less likely to leak from the container 100 through the base seals 108 and the shell seal 110. Furthermore, the cavity 104 of the container 100 may be filled to a pressure that is substantially the same as an environmental pressure in the surrounding area. Therefore, a pressure differential between the cavity 104 and the surrounding environment may be minimal, further reducing the potential for gas leaking into or out of the cavity 104.

Figure 6:
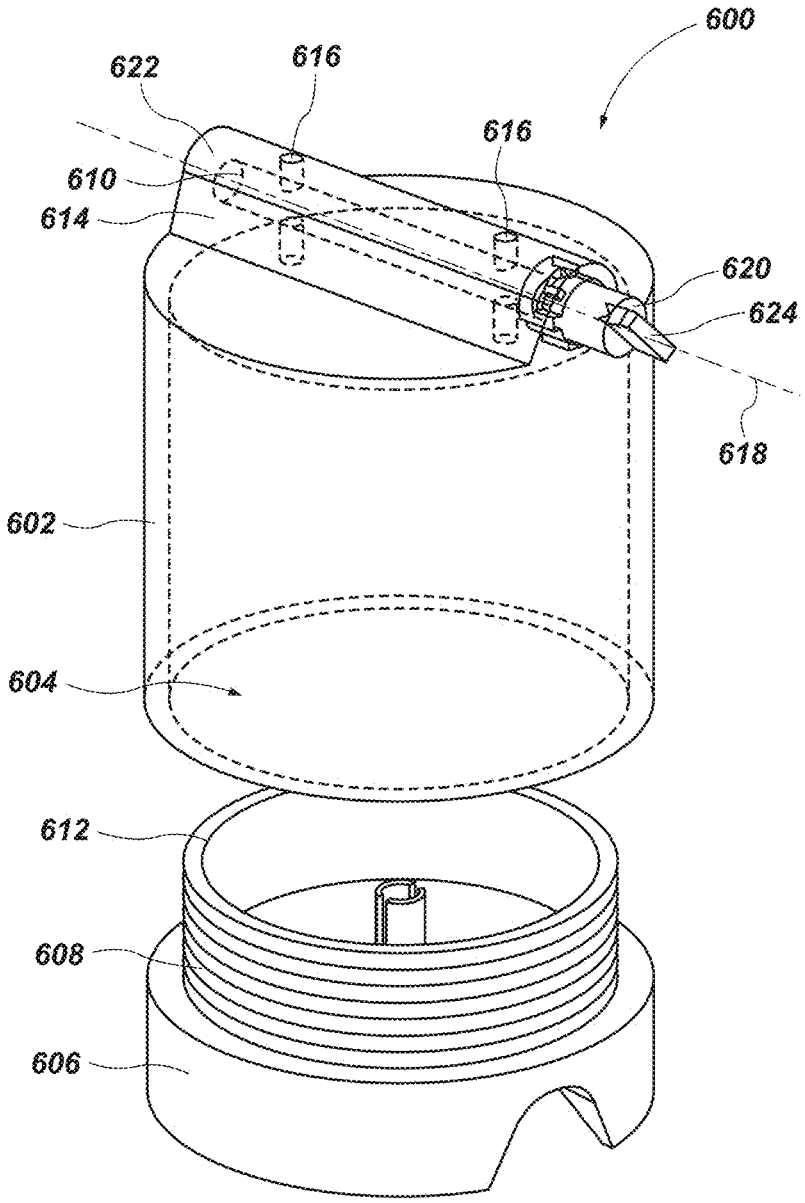
FIG. 6 illustrates an isometric view of a container in accordance with embodiments of the disclosure.
Figure 7:
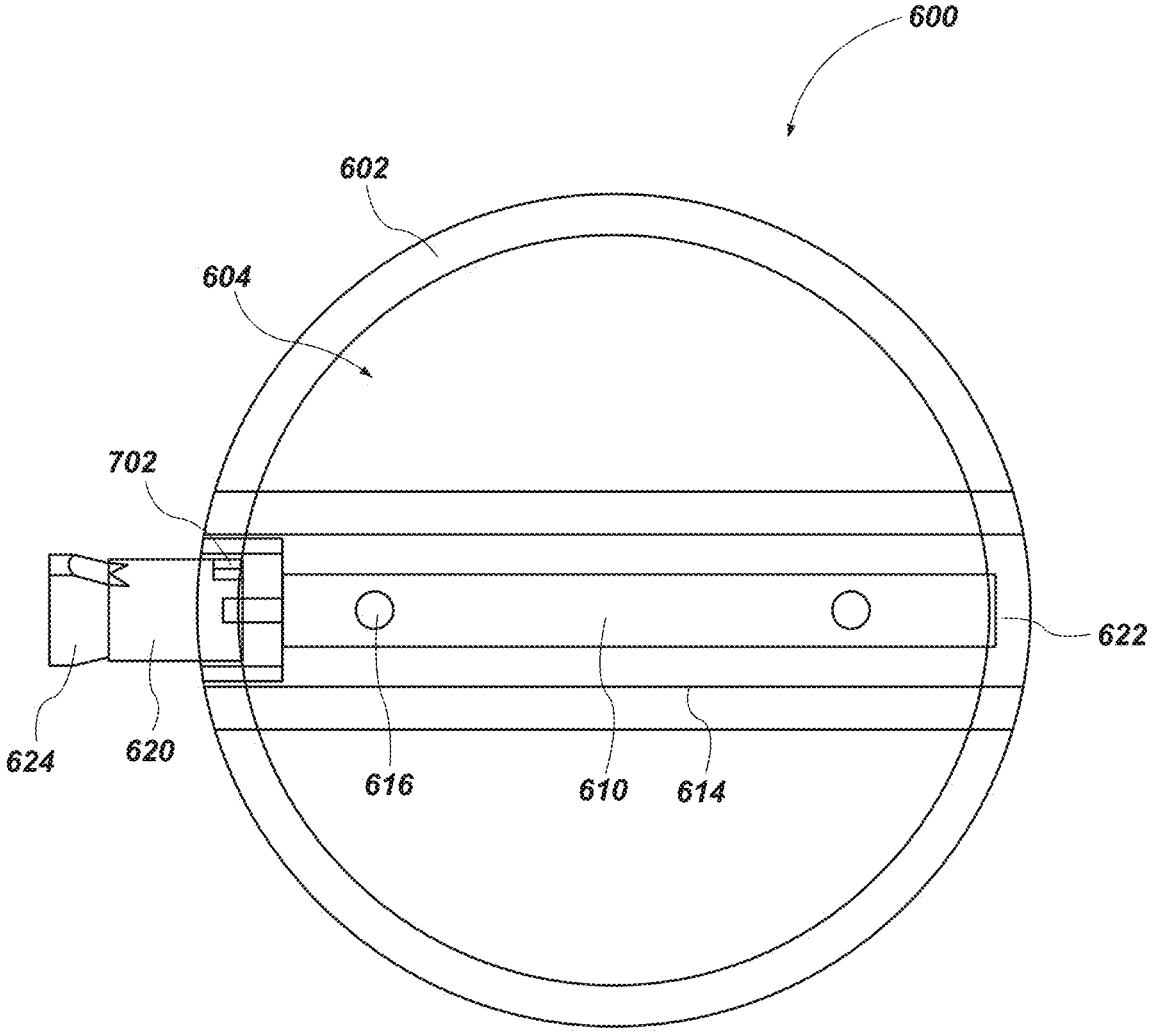
FIG. 7 illustrates a top view of a shell of the container of FIG. 6 in accordance with embodiments of the disclosure.
Figure 8:
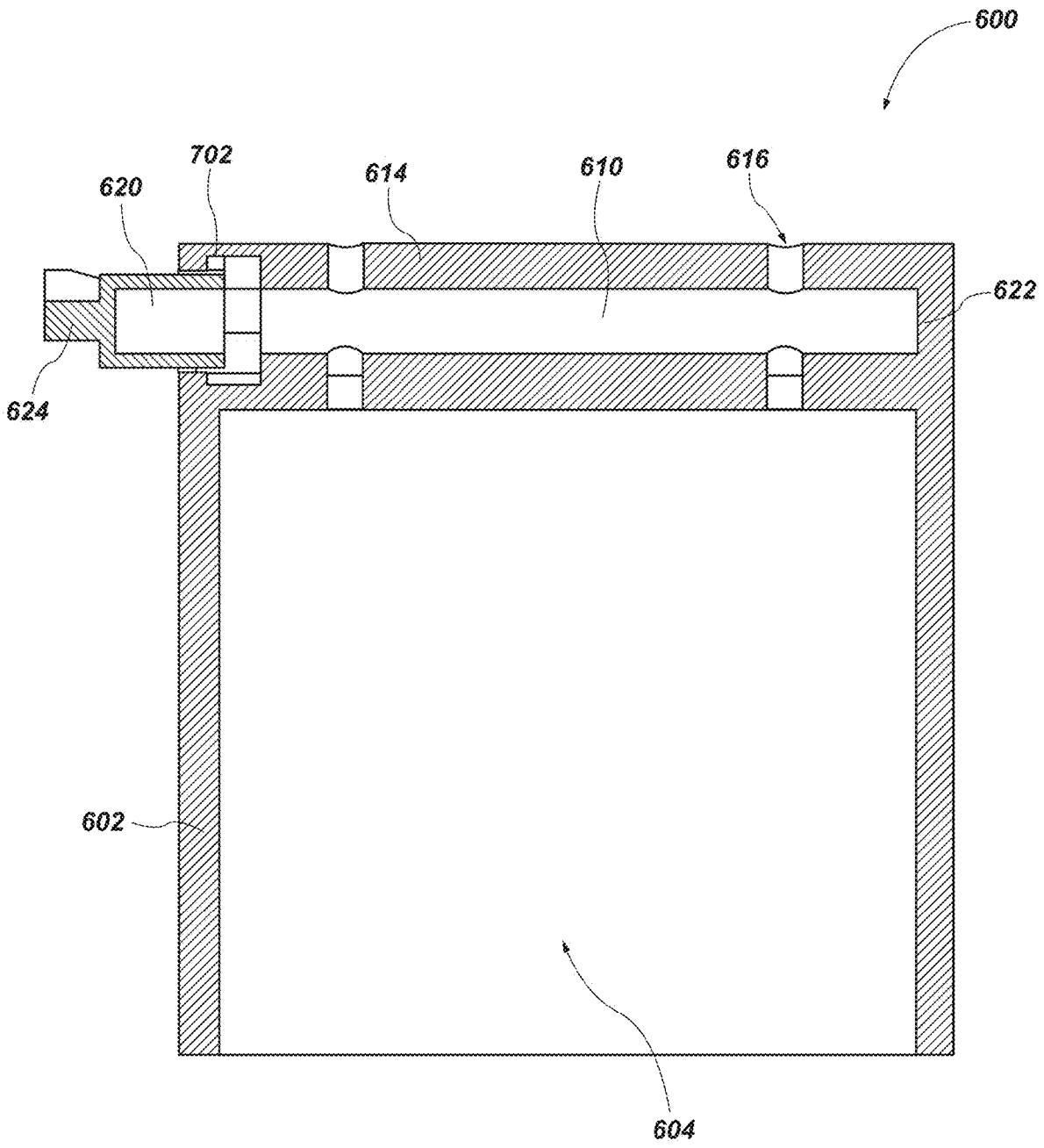
FIG. 8 illustrates a cross-sectional view of the shell of FIG. 7 in accordance with embodiments of the disclosure.

FIGS. 6-8 illustrate another embodiment of a container 600. Similar to the container 100 (FIG. 1), the container 600 includes a shell 602 configured to be disposed over a protrusion 612 extending from a base 606. The protrusion 612 includes one or more base seals 608 configured to interface with the shell 602 and form a substantially fluid tight seal between protrusion 612 of the base 606 and the shell 602. The combination of the base 606 and the shell 602 defines a cavity 604. The shell 602 also includes ports 616 defined in a shell seal structure 614 extending from an upper portion of the shell 602. The ports 616 provide fluid connections to the cavity 604 for providing a less reactive gas and exhausting oxygen and other atmospheric gases from the cavity 604.

The shell seal structure 614 is configured to house a shell seal 610. The ports 616 extend through the shell seal 610. In some cases, the ports 616 are created in the shell seal 610 by puncturing the shell seal 610 with a needle as discussed in further detail with respect to FIG. 1. In other cases, the shell seal 610 may be formed with ports 616 extending therethrough. The shell seal structure 614 may include a shell seal wall 622 on a first axial end along the axis 618 of the shell seal structure 614 and a clamping structure 620 on a second opposite axial end of the shell seal structure 614. The clamping structure 620 may include an interface 702 with the shell seal structure 614 configured to change an axial position of the clamping structure 620 through rotation and secure the clamping structure 620 in position, such as threads, a luer lock, a bayonet lock, etc. The interface 702 between the clamping structure 620 and the shell seal structure 614 may be configured to apply an axial force to the shell seal 610.

As illustrated in FIGS. 7 and 8, the shell seal 610 is positioned between the clamping structure 620 and the shell seal wall 622. Thus, as the clamping structure 620 moves axially inward, the shell seal wall 622 prevents the shell seal 610 from moving axially away from the clamping structure 620. Therefore, the combination of the clamping structure 620 and the shell seal wall 622 apply opposing axial forces to the shell seal 610, which are configured to substantially close the ports 616 defined in the shell seal 610 as described above, with respect to FIG. 1.

In another embodiment, the shell seal wall 622 may be positioned in a central portion of the shell seal structure 614 and two clamping structures 620 may be positioned on opposing axial ends of the shell seal structure 614. Two shell seals 610 may be disposed in the shell seal structure 614, with a first shell seal 610 on a first axial side of the shell seal structure 614 between a first clamping structure 620 and the central shell seal wall 622 and the second shell seal 610 on a second axial side of the shell seal structure 614 between a second clamping structure 620 and the central shell seal wall 622.

The clamping structure 620 may be configured to move axially inward a distance defined by a major dimension (e.g., diameter, width, apothem) of at least one of the ports 616. For example, the clamping structure 620 may move axially inward a distance in a range from about the major dimension of one of the ports 616 to about twice the major dimension of the one of the ports 616. The distance moved by the clamping structure 620 may cause the ports 616 defined in the shell seal 610 to collapse into themselves and close.

The clamping structure 620 may include a handle feature 624 configured to facilitate rotation of the clamping structure 620. For example, the handle feature 624 may be configured to provide a grip for a user's hands to turn the handle feature 624. As illustrated in the embodiment of FIGS. 6-8, the handle feature 624 is a flat protrusion extending axially outward from the clamping structure 620. The handle feature 624 may also be configured to interface with a tool, such as a wrench, pliers, a screwdriver, a drill, etc. For example, the protruding handle feature 624 illustrated in FIGS. 6-8 includes flats for gripping with a wrench or pliers. In another embodiment, the handle feature 624 may be a recess or groove configured to interface with a screwdriver or other tool.

Figure 9:
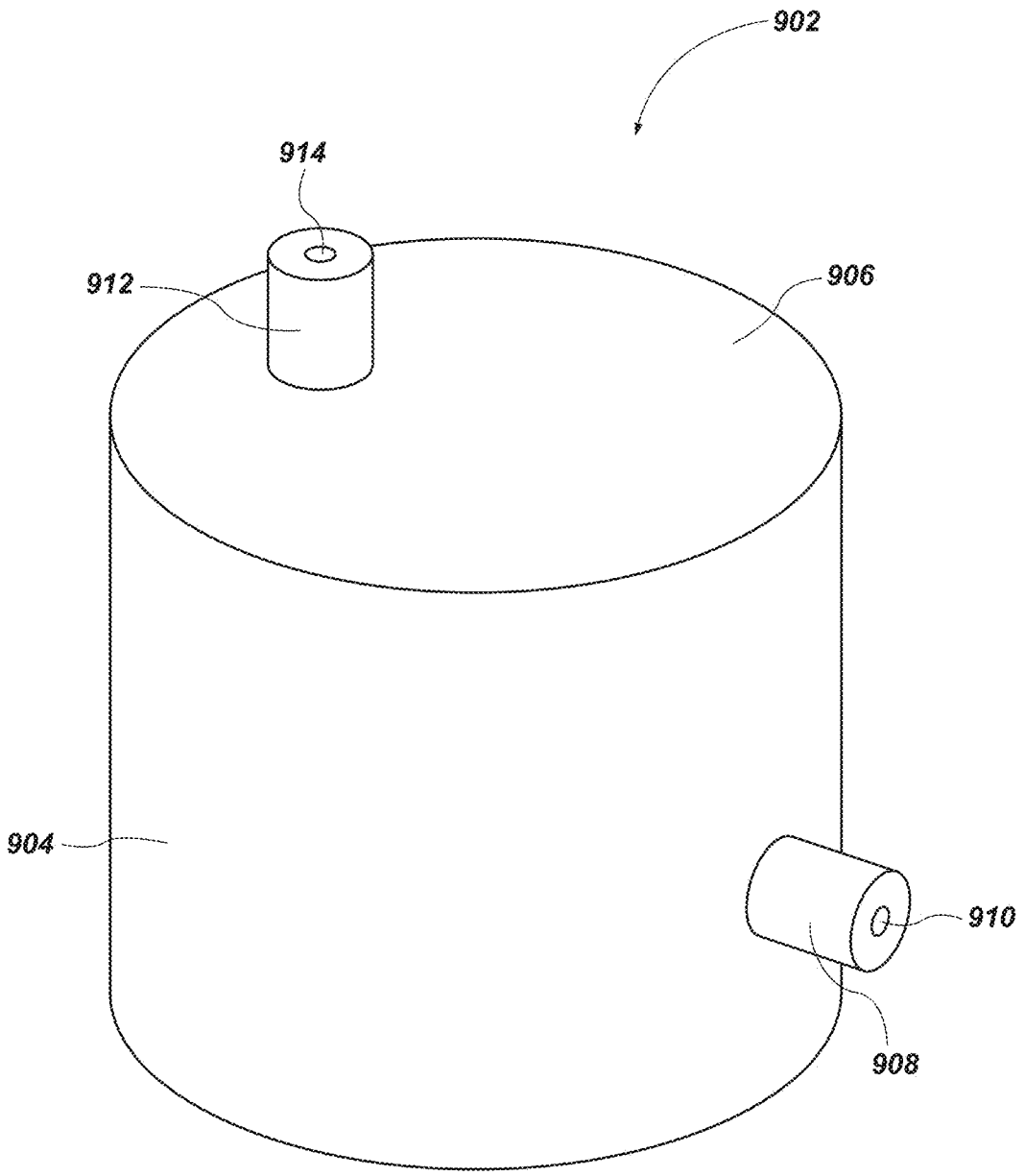
FIG. 9 illustrates an isometric view of a shell in accordance with embodiments of the disclosure.
Figure 10:
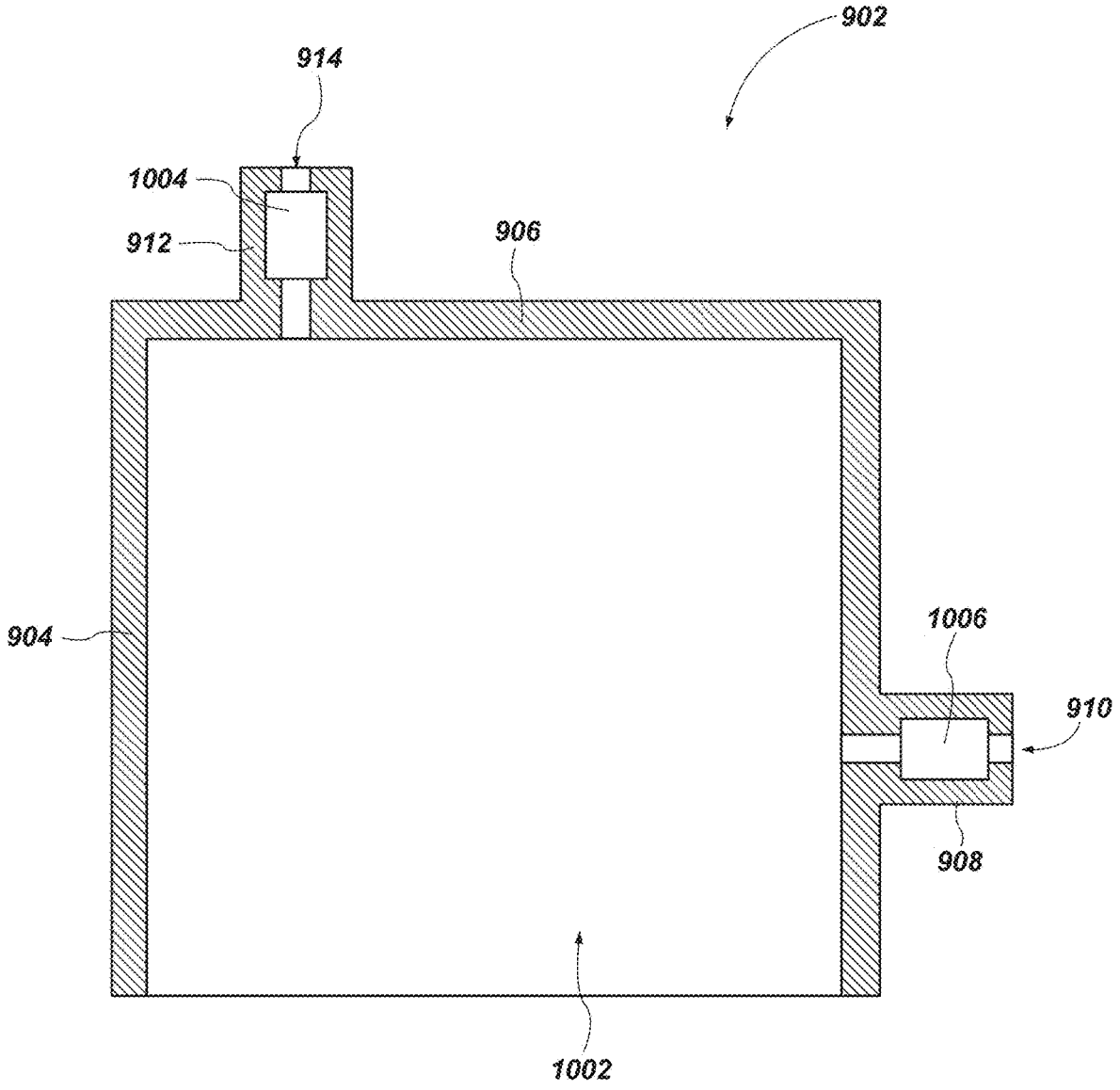
FIG. 10 illustrates a cross-sectional view of the shell of FIG. 9 in accordance with embodiments of the disclosure.

FIGS. 9 and 10 illustrate an isometric view and a cross-sectional view of another embodiment of a shell 902 that may be used with a base 106, 606 to form a container 100, 600 in accordance with embodiments described above. The shell 902 includes a side wall 904 and an upper wall 906 defining a cavity 1002 within. An inlet 908 is positioned on the side wall 904 and an outlet 912 is positioned on the upper wall 906. In the embodiment illustrated in FIGS. 9 and 10, the inlet 908 and the outlet 912 extend from the side wall 904 and the upper wall 906. In other embodiments, the inlet 908 and the outlet 912 may be defined and/or imbedded in the side wall 904 and/or the upper wall 906.

The inlet 908 includes an inlet port 910 configured to provide a fluid coupling between a fluid supply (e.g., less reactive gas supply, inert gas supply, etc.) and the cavity 1002. The inlet 908 may also include an inlet seal 1006 configured to seal the inlet port 910 when the inlet port 910 is not coupled to a fluid supply. For example, the inlet 908 may be a valve configured to be opened when coupled to a fluid supply and closed when not coupled to the fluid supply. In another example, the inlet seal 1006 may be a seal formed from a flexible material similar to the shell seals 110, 610 described above, and the inlet seal 1006 may be configured to be compressed to seal the inlet port 910 or to receive a plug through the inlet port 910 to seal the inlet port 910.

The outlet 912 includes an outlet port 914 configured to exhaust the oxygen and other atmospheric gases from the cavity 1002. The outlet 912 may also include an outlet seal 1004 configured to seal the outlet port 914 when the cavity 1002 has been filled with a less reactive gas. For example, the outlet 912 may be a valve configured to be opened when the inlet 908 is coupled to a fluid supply to facilitate exhausting the atmospheric gases from the cavity 1002 as the cavity 1002 is filled with the less reactive fluid and closed when the inlet 908 is not coupled to the fluid supply to maintain the less reactive fluid in the cavity 1002 and substantially prevent the ingress of atmospheric gases from the surrounding environment. In another example, the outlet seal 1004 may be a seal formed from a flexible material similar to the shell seals 110, 610 described above, and the outlet seal 1004 may be configured to be compressed to seal the outlet port 914 or to receive a plug through the outlet port 914 to seal the outlet port 914.

In the embodiment illustrated in FIGS. 9 and 10, the inlet 908 is positioned proximate a lower portion of the side wall 904. As discussed above, the less reactive gas supplied to the cavity 1002 may be heavier than oxygen and the other atmospheric gases. Supplying the less reactive gas into a lower portion of the cavity 1002 may cause the less reactive gas to remain in the lower portion of the cavity 1002 while pushing the lighter atmospheric gases upward in the cavity 1002 and out the outlet 912.

In the embodiment illustrated in FIGS. 9 and 10, the outlet 912 is positioned a distance radially from a center of the upper wall 906 of the shell 902. The inlet 908 is positioned on the side wall 904 on an opposite side of the shell 902 from the outlet 912. The distance between the inlet 908 and the outlet 912 may be configured to increase a distance that the fluid being supplied through the inlet 908 travels before reaching the outlet 912. The increased distance may be configured to reduce short cycling of the fluid (e.g., the fluid passing directly from the inlet 908 to the outlet 912 rather than sinking to the lower portion of the cavity 1002).

Figure 11:
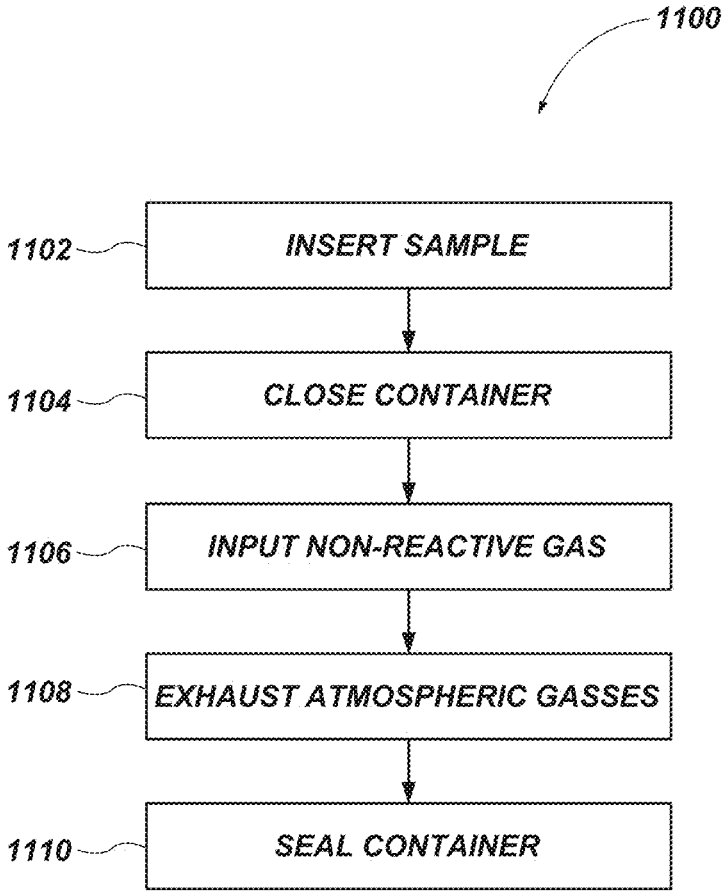
FIG. 11 illustrates a flow chart representative of a method of storing a sample in accordance with embodiments of the disclosure.

FIG. 11 illustrates a flow diagram representative of a method 1100 of storing a sample using any one of the containers 100, 600 described above. A sample is placed in the associated container in act 1102. For example, the sample may be secured to the base (e.g., base 106, 606) of the associated container. As discussed above, the base may include a feature configured to secure the sample to the base, such as a post (e.g., post 208) extending from the base.

After the sample is inserted into the container, the container is closed in act 1104. As discussed above, the container includes a shell (e.g., shell 102, 602, 902) and a base (e.g., base 106, 606). The container is closed by securing the shell to the base. The base may include one or more seals (e.g., base seals 108, 608) configured to form a substantially fluid tight seal between the shell and the base when the container is closed. Thus, a volume within the container may be substantially sealed to the ingress and egress of fluid. The container with the sample enclosed may be filled with atmospheric gases including oxygen and nitrogen.

The atmospheric gases may be replaced by inputting a non-reactive gas, such as an inert gas, in act 1106 and exhausting the atmospheric gases in act 1108. The pressure in the volume defined within the container may be maintained at substantially a same pressure as the environment outside the container. Thus, as the non-reactive gas is input into the container a similar volume of atmospheric gas may be removed or exhausted from the container. As discussed above, the non-reactive gas may be input through an input port (e.g., port 116, 616, 910) and the atmospheric gases may be removed or exhausted through an output port (e.g., 116, 616, 914).

After the atmospheric gases are replaced with the non-reactive gas in acts 1106 and 1108, the container is sealed in act 1110. In some embodiments, the inlet and outlet may include valves, such that the container may be sealed by closing the valves. In other embodiments, as discussed above, the inlet and outlet ports may be defined through a flexible sealing structure (e.g., shell seal 110, 610, 1004, 1006). The flexible sealing structure may be compressed through an axial force applied by a clamp (e.g., clamp 502) or clamping structure (e.g., clamping structure 620). In other embodiments, the ports through the flexible sealing structure may be closed with a plug or other insert configured to close the ports and form a seal with the flexible sealing structure.

As discussed above, the pressure in the internal volume of the container may be maintained at a similar pressure to the atmospheric pressure in the environments around the container. Therefore, a pressure differential between the internal volume and the surrounding environment may be substantially zero. In addition, no vacuum is needed. With little to no pressure differential, there may be little to no pressure across the different seals, such that the ingress or egress of gases from or into the volume of the container may be substantially reduced.

Embodiments of the disclosure may facilitate the storage of reactive samples by substantially removing reactive gases from around the samples. Removing the reactive gases may reduce the degradation of the reactive samples during storage. The embodiments of the disclosure may maintain the samples in a container having a pressure that is substantially similar to an external pressure. Maintaining similar pressures may substantially reduce the ingress and egress of gases into or out of the container. Limiting the ingress and egress of gases into or out of the container may facilitate storing the samples in the containers for longer periods of time, such as multiple months without significant degradation of the samples. The containers may, for example, be used to prevent or substantially reduce samples of nuclear materials from going airborne. Corrosion of the containers may also be substantially reduced.

Storing samples for longer periods of time may reduce testing costs, at least by reducing the amount of materials of the sample used. For example, reducing the degradation of samples may facilitate performing a greater number of tests on a single sample before replacing the sample. Storing samples for a longer period of time may also facilitate obtaining samples in greater volumes, which may reduce the costs of the samples. The container may be constructed from low-cost materials, such that the containers may be easily replaced and disposable.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A container comprising:

a base comprising at least one base seal; and a shell configured to be disposed at least partially over the base and interface with the at least one base seal, the shell comprising:

an inlet port extending through the shell, the inlet port configured to create a fluid connection to a cavity defined within the shell;

an outlet port extending through the shell, the outlet port configured to create a fluid connection to the cavity defined within the shell; and a flexible seal extending across the inlet port and the outlet port, the flexible seal configured to form a fluid tight seal between the cavity and the inlet port and the outlet port, the flexible seal configured to close the inlet port and the outlet port when axially compressed along an axis of the flexible seal.

2. The container of claim 1, further comprising a clamping device configured to axially compress the flexible seal and form the fluid tight seal between the cavity and the inlet port and the outlet port.

3. The container of claim 2, wherein the clamping device comprises a clamp configured to engage two opposing axial ends of the flexible seal.

4. The container of claim 3, wherein the clamp comprises a band clamp.

5. The container of claim 2, wherein the clamping device comprises a clamping structure configured to interface with a seal structure of the shell and engage a first axial end of the flexible seal.

6. The container of claim 5, wherein the seal structure of the shell comprises a shell seal wall positioned on a second axial end of the flexible seal, wherein the clamping structure is configured to compress the flexible seal between the first axial end of the flexible seal and the second axial end of the flexible seal.

7. The container of claim 5, wherein the clamping structure is configured to change an axial position of the clamping structure relative to the seal structure of the shell through a rotational interface between the clamping structure and the seal structure of the shell.

8. The container of claim 1, wherein the base comprises a protrusion comprising at least one annular recess configured to receive the at least one base seal.

9. The container of claim 8, wherein the shell is configured to be disposed over the protrusion of the base.

10. The container of claim 1, wherein the base comprises a post extending from a central portion of the base, the post configured to secure a sample to the base.

11. A method of storing a sample, the method comprising:

enclosing the sample in a volume defined by a container comprising a base comprising at least one base seal and a shell configured to be disposed at least partially over the base and interface with the at least one base seal;

removing atmospheric gases from the volume through an outlet port extending through the shell;

inputting a non-reactive gas into the volume through an inlet port extending through the shell, the non-reactive gas substantially replacing the atmospheric gases in the volume and maintaining a pressure of the volume; and sealing the container with a flexible seal extending across the inlet port and the outlet port by axially compressing the flexible seal to close the inlet port and the outlet port, the flexible seal configured to close the inlet port and the outlet port when axially compressed along an axis of the flexible seal.

12. The method of claim 11, wherein inputting the non-reactive gas comprises inputting an inert gas.

13. The method of claim 12, wherein inputting the inert gas comprises inputting the inert gas where an atomic weight of the inert gas is greater than an atomic weight of the atmospheric gases.

14. The method of claim 11, wherein inputting the non-reactive gas into the volume comprises inputting the non-reactive gas into the volume at a first position in the container below a second position in the container where the atmospheric gases are removed from the volume.

15. The method of claim 11, wherein compressing the flexible seal comprises applying an inward axial force on opposing axial ends of the flexible seal.

16. A sample container comprising:

a base comprising at least one base seal and a post configured to secure a sample to the base;

a shell configured to be disposed at least partially over the base and interface with the at least one base seal, the shell comprising:

an inlet extending through an upper surface of the shell, the inlet configured to create a first fluid connection to a cavity defined within the shell; and an outlet extending through the upper surface of the shell, the outlet configured to create a second fluid connection to the cavity defined within the shell; and a shell seal structure comprising a flexible seal, wherein the inlet and the outlet extend through the shell seal structure.

17. The sample container of claim 16, further comprising a clamping device configured to engage opposing axial ends of the flexible seal.

18. The sample container of claim 16, wherein the flexible seal comprises one or more of a rubber material and an elastomeric polymer material.

* * * * *